US005503077A

United States Patent [19]

Motley

[11] Patent Number: 5,503,077

[45] Date of Patent: Apr. 2, 1996

[54] EXPLOSIVE DETONATION APPARATUS

[75] Inventor: Jerry Motley, Arlington, Tex.

[73] Assignee: Halliburton Company, Houston, Tex.

[21] Appl. No.: 219,588

[22] Filed: Mar. 29, 1994

[51] Int. Cl.[6] ..... F42B 3/13; F42C 19/12

[52] U.S. Cl. ..... 102/202.5; 102/202.1; 102/202.7

[58] Field of Search ..... 102/202.1, 202.2, 102/202.3, 202.4, 202.5, 202.7, 275.6, 275.1

[56] References Cited

U.S. PATENT DOCUMENTS

| | | | |
|---|---|---|---|
| 3,117,519 | 1/1964 | Hamilton et al. | 102/202.1 |
| 4,592,280 | 6/1986 | Shores | 102/202.5 |
| 4,708,060 | 11/1987 | Bickes, Jr. et al. | 102/202.7 |
| 4,907,509 | 3/1990 | Lieberman | 102/202.5 |
| 4,924,774 | 5/1990 | Lenzen | 102/202.7 |
| 5,036,768 | 8/1991 | Dow et al. | 102/202.2 |
| 5,094,166 | 3/1992 | Hendley, Jr. | 102/202.7 |
| 5,230,287 | 7/1993 | Arrell, Jr. et al. | 102/202.1 |
| 5,309,841 | 5/1994 | Hartman et al. | 102/202.4 |
| 5,327,834 | 7/1994 | Atkeson | 102/202.1 |

*Primary Examiner*—Harold J. Tudor

*Attorney, Agent, or Firm*—William M. Imwalle; Robert A. Kent

[57] ABSTRACT

A detonator comprising a case into which is inserted a quantity of an explosive composition, a semiconductor bridge positioned adjacent one end of the explosive composition which is electrically connected to a spark gap and in some embodiments a capacitor and a bleeder resistor. A pair of electrically conductive wires are connected to the spark gap and semiconductor bridge to provide a means for passing an electrical charge to the semiconductor bridge. The detonator also may include an rf attenuator, such as a ferrite bead, through which the electrically conductive wires pass. The ends of the detonator case are sealed by any appropriate means.

12 Claims, 2 Drawing Sheets

FIG.3
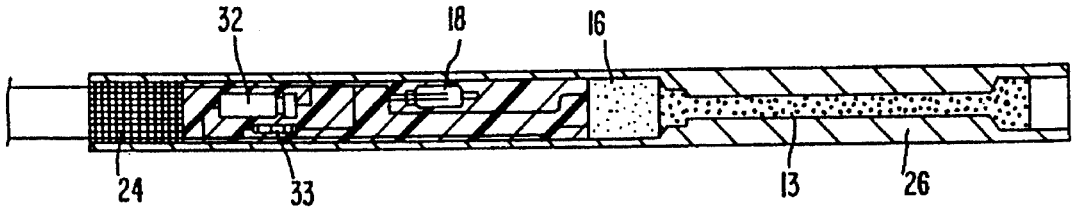
FIG. 4
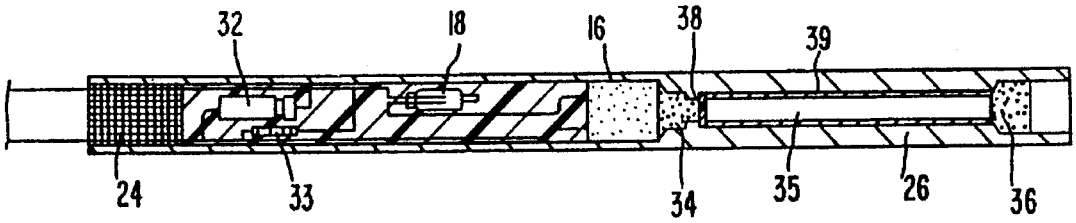
FIG. 5
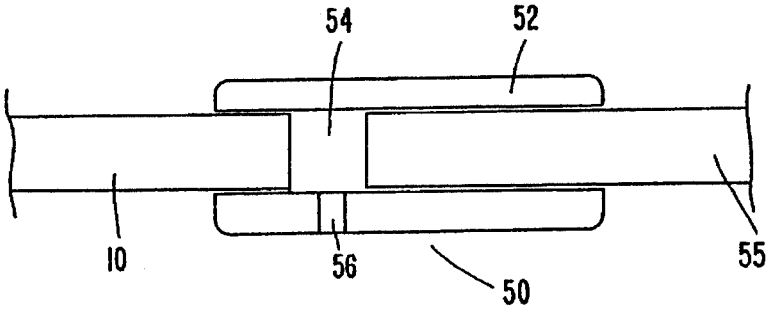
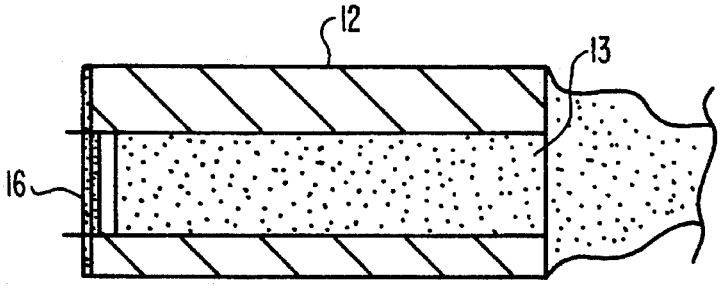
FIG. 6

EXPLOSIVE DETONATION APPARATUS

BACKGROUND OF THE INVENTION

1. Field of the Invention

The present invention relates to a thermally stable, impact and electrostatic discharge resistant explosive detonator. More specifically, the present invention relates to an explosive detonator including an rf attenuator, a semiconductor bridge, a spark gap, cyclotetramethylene tetranitramine or other explosive and titanium subhydride potassium perchlorate or 2-(5-cyanotetrazolato)pentaaminecobalt (III) perchlorate and, in some instances, a bleeder resistor and a capacitor.

2. Description of the Prior Art

It is well known in the art to initiate secondary explosive compositions by means of primary explosives. This method however, involves the use of materials which are subject to accidental initiation by extraneous sources such as, for example, heat impact, friction, electrostatic discharge or the like.

The advent of the exploding bridge wire provided a method of introducing a large amount of energy into a detonator. Presently available exploding bridge wire detonators usually contain lead azide or pentaerythritol tetranitrate (PETN) as the explosive material. The use of PETN, however, has limited the use of such detonators to relatively low temperature environments. Some detonators have used cyclotrimethylene trinitramine (RDX) or hexanitrostilbene (HNS) as the explosive material. The detonators have still required the introduction of a relatively large electrical charge into the bridgewire to heat the wire to a temperature at which it will explode.

Recently, a device referred to as a semiconductor bridge has been developed for ignition of pyrotechnics and explosives. The semiconductor bridge consists of an "H" shaped, doped silicon material sandwiched between a substrate and an aluminum land. The bridge area provides electrical connection between the lands and the electrical circuit is schematically illustrated in FIG. 1. The semiconductor bridge is actuated by a short, low energy pulse which may be in the range of from about 3 to 5 mJ that vaporizes the bridge material creating a hot plasma that ignites a small quantity of an explosive that is placed in intimate contact with the bridge. The assembly of the electrical circuit and small quantity of explosive in a metal or plastic shell is referred to as an SCB. SCB's operate at much lower input energies than conventional exploding bridgewire devices. A study of the mechanism of SCB's was conducted by Sandia National Laboratories and reported in 1989 in report number SAND 89-2033. The model study was directed to the initiation of the granular explosive 2-(5-cyanotetrazolato-)pentaaminecobalt (III) perchlorate (CP).

It would be desirable to produce a detonator having increased temperature stability, shock resistance, and electrostatic discharge resistance.

BRIEF DESCRIPTION OF THE DRAWINGS

FIG. 3 is a schematic illustration of another embodiment of the present invention including a capacitor.

FIG. 4 is yet another schematic illustration of the present invention utilizing a flying plate.

FIG. 5 is a schematic illustration of a fluid disable device for use with the detonator of the present invention.

FIG. 6 is a schematic illustration of the placement of a semi-conductor bridge for use the detonator of the present invention.

SUMMARY OF THE INVENTION

The discovery now has been made that a detonator may be prepared having improved impact resistance, electrostatic discharge resistance and thermal stability utilizing 2-(5-cyanotetrazolato)pentaaminecobalt (III) perchlorate (CP) or titanium subhydride potassium perchlorate (THKP) in combination with a semiconductor bridge to form an ignition source (SCB). The detonator comprises a case or shell having an open end into which is inserted in sequence, a quantity of granular cyclotetramethylene tetranitramine (HMX) or other explosive, an SCB positioned adjacent one end of the HMX which is electrically connected to a spark gap and in some embodiments a capacitor and bleeder resistor and finally an rf attenuator. The electrical connections extend outward from the rf attenuator through the end of the case. The components are sealed or otherwise bonded within the casing to form the detonator. In an optional embodiment, the detonator may include a flying plate initiator.

DESCRIPTION OF THE PREFERRED EMBODIMENT

Figure 2:
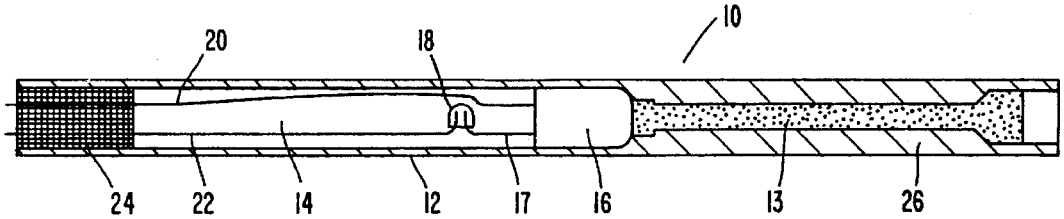
FIG. 2 is a schematic illustration of one embodiment of the detonator of the present invention.

FIGS. 2–4 provide a schematic illustration of variations of the detonator 10 of the present invention comprising a casing or shell 12, having a varying diameter bore therethrough containing a quantity of HMX or other explosive identified as 13, an SCB 16 and a spark gap 18 which are connected by a pair of electrically conductive wires 20 and 22 to a means for introducing an electrical charge into the SCB 16, rf attenuator 24 and means for sealing the casing and various optional constituents such as a bleeder resistor and a capacitor in the electrical circuit.

The casing or shell 12 of the detonator 10 of the present invention comprises a cylindrical tube having a bore 14 of varying diameter therethrough, the diameter being sufficient to permit inclusion of an SCB within the bore 14. Typically the wall thickness of the case will be in the range of from about 0.075 to about 0.125 inches. The casing 12 may be comprised of substantially any material of high acoustic impedance such as, for example, aluminum, steel and particularly stainless steel, brass, rigid plastics and the like capable of withstanding exposure to a temperature of about 400° F. for a period of at least about one hour without structural failure.

Figure 1:
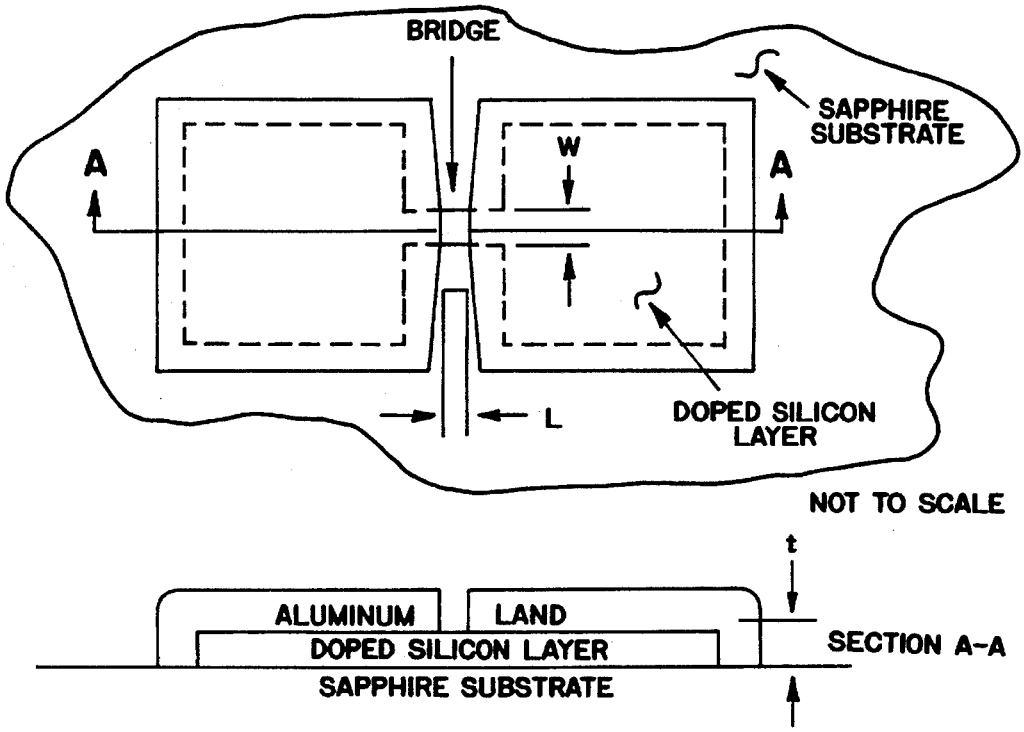
FIG. 1 is a schematic illustration of the electrical circuit of an SCB.

The SCB 16 is positioned within the casing 12 such that it will be in intimate contact or at least close proximity to the explosive to be placed within the bore 14. Preferably, the SCB 16 is positioned such that it will be in contact with the surface of the explosive exposed in bore 14. The SCB 16 may be substantially any of those which are commercially available in a size capable of insertion within the casing. Suitable SCB's are available, for example, from Thikol Corporation, Elkton, Md., and SCB Technologies, Inc., Albuquerque, New Mexico. The SCB 16 preferably is of the type activated by an electrical charge of from about 18 to about 24 volts at an amperage of from about 3 to about 4 amps. It is to be understood however, that other SCB's also may be suitable if they result in initiation of the deflagration reaction with the explosive composition in the detonator. The design of the SCB 16 is generally of the type having the electrical circuit illustrated in FIG. 1, and which was previously described. Referring now to FIG. 6 if desired, the SCB may be prepared by compressing a quantity of from about 50 to about 100 milligrams of CP or THKP 16C in a suitable size metal or plastic container "**16*b* having a bore 16*d* therethrough," into intimate contact with a semiconductor bridge 16*a*. Typically the CP or THKP 16C is compressed by application of from about 10,000 to 12,000 psi of force to the material. The open end of the container 16*b*** having the electrical connections extending therefrom may be sealed by, for example, epoxy or the like.

The THKP utilized in the present invention is defined by the formula $TiH_x/KClO_4$ wherein x is greater than 0.6 and less than 1.9. The THKP is available from, for example, SCB Technologies, Inc., Albuquerque, N.M. THKP may be produced by a number of commercially known methods. One successful method of synthesis involves a very carefully controlled vacuum heating cycle followed by a controlled air oxidation step to thermally dehydride commercially available titanium hydride. This product is then blended with potassium perchlorate to yield the THKP. Generally, the subhydride is blended with the perchlorate in a ratio of about 1:2 by weight, however, it is to be understood that other ratios known to those skilled in the art may be employed.

Referring now to FIG. 2.

An explosive charge 13 is positioned within an end 26 of the case 12 to improve initiation of a detonating cord such as a "PRIMACORD™" detonating cord manufactured by Ensign-Bickford Company or other secondary explosive. The explosive charge is introduced into the casing as a powder and thereafter is compressed by application of, for example, a ram to the explosive at end 26 of casing 12. Typically the explosive charge may comprise HMX, hexanitrostilbene (HNS) bis(picrylamino) trinitropyridine (PYX), trinitrotrimethylenetriamine (RDX) and mixtures thereof, or the like. The end 26 of casing 12 may be sealed by a thin metal or plastic disk which is pressed into place or by a thin layer of epoxy to provide a seal on the exposed end of the explosive in the bore 14 in detonator 10.

The HMX or other explosive is compressed to a density in the range of from about 1.4 to about 1.6 grams per cubic centimeter at the exposed end. This results in a variation in the density of the HMX or other explosive in the bore from approximately the bulk density of the explosive at one end to the full compressed density at the other end. The length of the bore is such that the quantity of HMX present will, upon initiation, effect a transition from deflagration-to-detonation prior to passage of the combustion front through the mass of compressed HMX present within the bore. Typically, the bore 14 will have a length of at least about 1 inch for a bore diameter of about 0.1 inches. The bore within the casing 12 generally is flared in a frustoconical manner at the end at which initiation is to occur to provide a larger surface area upon which to initiate deflagration.

The SCB 16 is connected by an electrically conductive wire 17 to a spark gap. The spark gap 18 is utilized to protect the detonator against accidental initiation by an electrostatic discharge. Suitable spark gaps are available from, for example, Reynolds Industries and Lumex Opto. Typically the spark gap will have a voltage threshold of from about 80 to about 200 volts before passage of an electrical charge to the SCB 16 occurs. Spark gaps are available with various ratings and detonators can be prepared having different known spark gaps to permit controlled initiation of individual or multiple explosive charges in response to different electrical charges transmitted from an electrical source.

To facilitate placement of the SCB 16 and spark gap 18 within the casing 12, the components are preferably potted in a plastic resin such as epoxy or other material as shown in FIGS. 3 and 4, or affixed to a substrate to permit maintenance of a fixed position within the casing 12. While not required or essential, potting of the electrical components assists in reducing detonator failures.

The SCB 16 and spark gap 18 are provided with electrically conductive wires 20 and 22 which provide an electrical connection which extends outside of the casing 12. The casing 12 can be sealed by insertion of, for example, an rf attenuator, comprising a ferrite bead having passageways therethrough for the wires passing from the end of the casing 12. The casing 12 then may be crimped to retain the bead in position. The rf attenuator reduces the strength of any radio signal present to a level whereby the signal is incapable of accidental initiation of the detonator. Suitable devices include the MN 68 ferrite device available from Attenuation Technologies, La Plata, Md. The casing 12 also may be sealed with plastic resins or the like which bond to the casing, in lieu of an rf attenuator, to seal the various components within the casing.

In an alternate embodiment of the present invention, illustrated schematically in FIG. 3, a capacitor 32 and a bleeder resistor 33 may be included within the electrical circuit created by the SCB 16 and spark gap 18 within the detonator casing 12. The capacitor 32 is utilized to store electrical energy sufficient to pass the spark gap and initiate the SCB and the resistor is used to slowly drain the capacitor in the event the capacitor is partly charged during an interrupted firing of the detonator. Typically, the capacitor is selected to provide a capacitance of 3.5 mF and the resistor is chosen to have a 10,000 to 20,000 ohm resistance. Suitable capacitors and resistors are available from, for example, Carlton-Bates Co., Texarkana, Tex.

In yet another embodiment of the present invention, illustrated schematically in FIG. 4, initiation of the explosive charge is effected with a flying plate. In this embodiment, the end 26 of bore 14 is divided into segments 34, 35 and 36 and one segment contains no explosive. A quantity of granular explosive is positioned within segment 34 of bore 14 and compressed adjacent the SCB 16. A disk 38 then is inserted into the casing 12. The disk 38 generally has a diameter substantially the same as the inner diameter of the casing 12. The disk 38 may be comprised of aluminum, plastic or the like in accordance with the known techniques of initiation using flying plates. The thickness of the plate may vary, with the specific thickness being dependant on the energy necessary to detonate the explosive charge. The flying plate material selection and size determinations are considered to be well within the knowledge and capabilities of those individuals skilled in the art. In one embodiment a retainer 39 then is inserted within segment 35 of the casing 12 adjacent to the disk 38 and a prepressed pellet of explosive is positioned within segment 36 with the remainder of the detonator 10 being as previously described.

The detonator 10 of the present invention may be utilized in environs subject to fluid influx in which it is desired to disable an explosive charge in the presence of such fluids. One particular application wherein a fluid disable is desirable is in the operation of subterranean formation perforating guns. Typically, the guns comprise a number of perforating charges contained within a sealed metal housing. If fluids enter the interior of the housing the performance of the perforating charges is effected and it also may result in misfires of the charges. When used, for example, in a perforating gun to activate a detonating cord connected to the perforating charges, the detonator may be connected to the detonating cord with a coupler 50 of the type schematically illustrated in FIG. 5. The coupler 50 comprises a body 52 having a bore 54 therethrough which may have differing diameters down its length. The bore 54 is of a diameter at one end sufficient to fit over the end, in preferably a compression fit, of the detonator 10. The other end of the bore 54 is such as to accept insertion of the end of a detonating cord therein. The bore 54 is of sufficient length that a void remains between the opposed end faces of the detonator and detonating cord when positioned within the coupler. The coupler also includes at least one port 56 through the side wall of the coupler 50 in the region of the void. The port 56 is of sufficient size that upon exposure of the coupler 50 to a fluid, the fluid can flow through the port 56 and into the void. Entry of a fluid into the void will, upon detonation of the detonator, result in energy absorption by the fluid so as to prevent activation of the detonating cord. While the coupler 50 has been described as a device separate from said detonator 10, it is to be understood that a detonator casing could be produced in which the features of the coupler 50 would be incorporated and whereby a direct connection of the detonator could be effected with a detonating cord.

To further illustrate the present invention and not by way of limitation, the following example is provided.

EXAMPLE

A detonator is prepared utilizing a casing comprising 303 Stainless Steel having a diameter of 0.312, a length of 4.3 inches, and a wall thickness of about 0.106. A quantity of HMX is pressed into the bore in the end of the casing having the cross-section as illustrated in FIG. 2. An SCB is connected to a spark gap and potted in epoxy within the casing prior to addition of the HMX. The electrical connections for the SCB and spark gap are passed through a rubber washer which is crimped within the end of the casing, sealing the detonator. The detonator was secured in a test fixture and connected to an electrical power source. An electrical charge having a voltage of 80–200 volts and current of 2.0 amps which was then applied to the detonator. The detonator fired.

While that which is considered to comprise the preferred embodiments of the invention has been described herein, it is to be understood that changes and modifications may be made in the apparatus and chemical compositions by an individual skilled in the art without departing from the spirit or scope of the invention as set forth in the appended claims.

What is claimed is:

1. An electrical detonator comprising: a casing;

an explosive composition comprising at least one member selected from the group of hexanitrostilbene, cyclotetramethylene tetranitramine, bis(picrylamino) trinitropyridine and trinitrotrimethylenetriamine contained within said casing;

a semiconductor bridge positioned adjacent said explosive composition and in intimate contact with a quantity of titanium subhydride potassium perchlorate or 2-(5-cyanotetrazolato)pentaaminecobalt (III) perchlorate;

a spark gap electrically connected to said semiconductor bridge; and a pair of electrically conductive wires which penetrate said casing and connect to said spark gap and semiconductor bridge to provide a means of introducing an electrical charge into said semiconductor bridge.

2. The apparatus of claim 1 defined further to include an rf attenuator positioned at an end of said casing having the electrically conductive wires passing therethrough.

3. The apparatus of claim 2 defined further to include a capacitor connected to said spark gap whereby discharge of said capacitor transmits an electrical charge through said spark gap to the semiconductor bridge.

4. The apparatus of claim 3 defined further to include a bleeder resistor which is positioned across the electrically conductive wires within said casing.

5. The apparatus of claim 1 wherein said subhydride is defined by the formula $TiH_x/KClO_4$ wherein x is greater than 0.6 and less than 1.9.

6. The apparatus of claim 1 wherein at least a portion of said explosive composition is compressed in said casing to a density of from about 1.4 to about 1.6 grams per cubic centimeter.

7. An electrical detonator comprising: a casing;

an explosive composition comprising at least one member selected from the group of hexanitrostilbene, cyclotetramethylene tetranitramine, bis(picrylamino) trinitropyridine and trinitrotrimethylenetriamine contained within said casing;

a semiconductor bridge positioned adjacent said explosive composition and in intimate contact with a quantity of titanium subhydride potassium perchlorate or 2-(5-cyanotetrazolato)pentaaminecobalt (III) perchlorate;

a spark gap electrically connected to said semiconductor bridge;

a capacitor electrically connected to said spark gap;

a pair of electrically conductive wires which penetrate said casing and connect to said semiconductor bridge and said capacitor to provide a means of introducing an electrical charge into said semiconductor bridge, and a bleeder resistor connected to said pair of electrically conductive wires.

8. The apparatus of claim 7 defined further to include an rf attenuator positioned at an end of said casing having said electrically conductive wires passing therethrough.

9. The apparatus of claim 8 wherein said rf attenuator comprises a ferrite bead.

10. The apparatus of claim 7 defined further to include a quantity of epoxy to seal the electrical components within said casing.

11. The apparatus of claim 7 wherein said subhydride is defined by the formula $TiH_x/KClO_4$ wherein x is greater than 0.6 and less than 1.9.

12. The apparatus of claim 7 wherein at least a portion of said explosive composition is compressed in said casing to a density of from about 1.4 to about 1.6 grams per cubic centimeter.

* * * * *